US009138742B2

(12) United States Patent
Scott et al.

(10) Patent No.: US 9,138,742 B2
(45) **Date of Patent: *Sep. 22, 2015**

(54) RECEIVER PLATE WITH MULTIPLE CROSS-SECTIONS

(71) Applicant: EMD Millipore Corporation, Billerica, MA (US)

(72) Inventors: Christopher A. Scott, Westford, MA (US); Brian Foley, Westford, MA (US)

(73) Assignee: EMD Millipore Corporation, Billerica, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/514,853

(22) Filed: Oct. 15, 2014

(65) Prior Publication Data

US 2015/0064081 A1 Mar. 5, 2015

Related U.S. Application Data

(63) Continuation of application No. 11/132,996, filed on May 19, 2005, now Pat. No. 8,968,679.

(51) Int. Cl.
*B01L 3/00* (2006.01)

(52) U.S. Cl.
CPC ..... *B01L 3/50255* (2013.01); *B01L 3/5085* (2013.01); *B01L 2200/025* (2013.01);
(Continued)

(58) Field of Classification Search
CPC ..... B01L 3/50255
USPC ..... 422/552, 503, 534
See application file for complete search history.

(56) References Cited

U.S. PATENT DOCUMENTS 5,096,672 A 3/1992 Tervamaki et al.
5,141,718 A 8/1992 Clark
(Continued)

FOREIGN PATENT DOCUMENTS

EP 1394247 A1 3/2004
EP 1524033 A1 4/2005
(Continued)

OTHER PUBLICATIONS

English translation of Chinese communication issued Sep. 4, 2009 in corrresponding Chinese patent application No. 200610084764.9.
(Continued)

*Primary Examiner* — Natalia Levkovich
(74) *Attorney, Agent, or Firm* — Nields, Lemack & Frame, LLC

(57) ABSTRACT

A multi-well assembly including a filter plate and receiver plate. Each plate includes a plurality of wells, which, when the filter plate is placed in nesting relationship with the receiver plate, each filter plate well has a corresponding receiver plate well into which it extends. The receiver plate wells are of a non-uniform cross-section in order to increase the gap between the outer walls of the filter plate wells and the inner walls of a corresponding receiver plate well when the receiver plate and filter plate are in nesting relationship. The increased gap size reduces wicking and cross-contamination. A multi-section well of maximum cross-section in an upper region and a minimized cross-section in a lower region, with a gradual transition between the regions, is thus provided. The multi-well assembly of the present invention also improves the repeatability of positioning the filter plate and receiver plate in proper nesting relationship and provides stability during handling, mixing and shaking operations.

5 Claims, 7 Drawing Sheets

(52) U.S. Cl.
CPC .. *B01L2200/0678* (2013.01); *B01L 2200/0684* (2013.01); *B01L 2200/141* (2013.01); *B01L 2300/0681* (2013.01); *B01L 2300/0829* (2013.01); *B01L 2300/0858* (2013.01)

(56) References Cited

U.S. PATENT DOCUMENTS

| | | | |
|---|---|---|---|
| 5,516,490 | A | 5/1996 | Sanadi |
| 5,650,323 | A | 7/1997 | Root |
| 5,972,694 | A | 10/1999 | Mathus |
| 6,083,761 | A | 7/2000 | Kedar et al. |
| 2003/0215956 | A1 | 11/2003 | Reed |
| 2006/0263875 | A1 | 11/2006 | Scott et al. |

FOREIGN PATENT DOCUMENTS

| | | | |
|---|---|---|---|
| GB | 2259655 | A | 3/1993 |
| JP | 2006-231166 | A | 9/2006 |
| WO | 00/25922 | A2 | 5/2000 |
| WO | 2004/078352 | A2 | 9/2004 |

OTHER PUBLICATIONS

Chinese communication, with English translation, issued Apr. 27, 2010 in corresponding Chinese patent application No. 200610084764.9.

European communication dated Sep. 20, 2006 in corresponding European patent application No. 06252562.1.

Indian communication dated Jan. 23, 2009 in corresponding Indian patent application No. 1126/DEL/2006.

Japanese communication, with English translation, mailed Apr. 28, 2009 in corresponding Japanese patent application No. 2006-136441.

English translation of Japanese communication mailed Aug. 3, 2010 in corresponding Japanese patent application No. 2006-136441.

Singapore communication dated May 28, 2007, including Australian Search Report dated May 18, 2007, in corresponding Singapore application 200602946-6.

Singapore communication, dated Aug. 6, 2008, including Australian Exam Report dated Jul. 1, 2008, in corresponding Singapore application 200602946-6.

RECEIVER PLATE WITH MULTIPLE CROSS-SECTIONS

This application is a continuation of U.S. patent application Ser. No. 11/132,996 filed May 19, 2005, the disclosure of which is incorporated herein by reference.

BACKGROUND OF THE INVENTION

The bioavailability of a drug is affected by a number of factors including its ability to be absorbed into the blood stream through the cells lining the intestines. There are a number of different in vitro assay options available to predict the gastrointestinal absorption property of drugs including a permeability assay, and a method known as PAMPA (Parallel Artificial Membrane Permeability Assay), which uses a lipid filled membrane to simulate the lipid bilayer of various cell types, including intestinal epithelium. These non-cell based permeability assays are automation compatible, relatively fast (4-24 hours), inexpensive, and straightforward. They are being used with increasing frequency to determine the passive, transcellular permeability properties of potential drug compounds. The majority of drugs enter the blood stream by passive diffusion through the intestinal epithelium. Consequently, permeability assays that measure passive transport through lipophilic barriers correlate with human drug absorption values from published methods.

Assays that predict passive absorption of orally administered drugs have become increasingly important in the drug discovery process. The ability of a molecule to be orally absorbed is one of the most important aspects in deciding whether the molecule is a potential lead candidate for development. Cell-based assays, like those using Caco-2 cells, are commonly used as a model for drug absorption; however, the technique is labor intensive and is often situated late in the drug discovery process. Assays described by Kansy and Faller have addressed these issues by providing rapid, low cost and automation friendly methods to measure a compound's passive permeability. Both permeability and PAMPA assays use artificial membranes to model the passive transport properties of the cell membrane. Other researchers have presented variations on Kansy's method, in some cases, improving on the correlation with a particular target (e.g., blood-brain barrier) or class of molecules. In general, the original assay has remained the same.

The devices used to carry out permeability assays include a filter plate containing one or more wells with a membrane barrier fixed to the bottom of each well, and a receiver plate configured to receive the filter plate in a nested relationship. Reagents and buffers are placed with the filter wells and the receiver wells at specific volume ratios so that accurate drug transport data can be analyzed. It is desirable to have the filter plate wells with membrane inserted into the receiver plate wells so that the media in the receiver plate wells will be at or close to equal level with the media in the filter wells. This creates hydrostatic equilibrium and minimized pressure differentials, which can cause uncontrolled or forced diffusion through the membrane. At a minimum however, the membrane must remain in contact with the liquid in the receiver plate during the experiment, including during incubation, shaking, and mixing. Cell culture assays (e.g., Caco-2) and non-cell based screening assays (e.g., PAMPA) are described in this manner. These devices also have non-cell based applications, which offer higher throughput compared to Caco assays, and require larger membrane areas to help achieve this.

Analysis is performed by reading directly in a transport assembly with UV or visual readers. It is therefore desirable to have a receiver plate that allows UV and visual light transmission. The protocol may also require shaking or other means of agitating the media, as well as extended incubation at room temperature. Handling of the device can be done manually or with automated plate handlers. In the latter case, the device needs to be compatible with the ANSI/SBS Microplate Standards (incorporated herein by reference) which apply mainly to the size, shape, and profile of the outer walls of the plate. These standards also restrict the well array by standardizing the distance between well centers and the location of the array relative to the outside of the plate.

Conventional receiver plates used in non-cell based PAMPA type assays include opaque acceptor plates and clear polystyrene receiver plates. Capillary wicking, cross contamination, volume control, evaporation, automation compatibility, and liquid recovery are problematic in these devices, however. The primary cause of cross contamination is the wicking of liquid in the small gap between each filter well and receiver well when the two plates are nested together, especially during incubation and shaking of the device. In conventional devices each receiver plate well has a circular cross section and thus forms a uniform capillary gap with a corresponding well of the concentrically nested filter plate, allowing for the wicking and cross contamination to occur. With these conventional devices, the cross-section is also uniform from the top to the bottom of the well, which increases the volume in the lower section of the well located under the membrane. Also with these conventional devices, the uniform capillary gap in the upper section of the well can hold only a minimum volume of media, and therefore when the device is assembled, there is a greater chance of displacing liquid out of the well, which leads to cross contamination. In the conventional devices, there are no features to assist in automated assembly and disassembly of the filter plate with the receiver plate. In conventional devices, the filter plate nests in the receiver plate such that there is a gap between the two, thus creating open paths to the atmosphere for evaporation of media from the receiver wells.

It therefore would be desirable to provide a receiver plate that reduces or eliminates capillary wicking and cross contamination.

It further would be desirable to provide a receiver plate that readily accommodates visual readers.

It further would be desirable to provide a receiver plate that minimizes the media volume requirements in the receiver plate.

It further would be desirable to provide a receiver plate that can handle a wider range of receiver volumes such that the membrane remains in liquid contact and the media does not displace out of the wells when the device is assembled.

It further would be desirable to provide a receiver plate that has features to assist in the automated assembly and disassembly of the filter plate.

It further would be desirable to provide a receiver plate that will nest such that each filter well is centered within each receiver well with minimal variation during the course of the experiment.

It still further would be desirable to provide a receiver plate that minimizes the effects of evaporation of media from the wells during non-humidified incubation.

SUMMARY OF THE INVENTION

The problems of the prior art have been overcome by the present invention, which provides a multi-well assembly including a filter plate and a receiver plate. Each plate includes a plurality of wells, which, when the filter plate is placed in a nesting relationship with the receiver plate, each filter plate well has a corresponding receiver plate well into which it extends in nesting relationship. The receiver plate wells are of a non-uniform cross section along the height of the well. The cross-section of the upper portion of the receiver plate well is chosen to increase the gap between the outer walls of the filter plate wells and the inner walls of a corresponding receiver plate well when the receiver plate and filter plate are in a nesting relationship. This cross section creates a non-uniform gap such that the increased gap size reduces wicking and cross-contamination as well as increases the volume around the filter well to accommodate larger media volume variations. The lower portion of the receiver plate well has a reduced cross section compared to the upper portion, thus forming a non-uniform cross-section along the well height. This reduced volume lower section reduces the media required for the experiment. In a preferred embodiment, the cross-section of the receiver plate wells transitions from a square cross-section to a round cross-section. Preferably the portion of each receiver plate well that accommodates the filter plate well is square or substantially square in cross-section, and transitions to a circular or other geometric cross-section just below where the membrane on the filter plate well would be positioned when the filter plate is in nesting relationship with the receiver plate. The square cross-section also provides larger pathways for air to escape during assembly of the device. A square cross section maximizes the useable space between neighboring wells given a circular filter well and the limitations of ANSI/SBS restrictions on well spacing. A multi-section well of maximum cross-section in an upper region and a minimized cross-section in a lower region, with a gradual transition between the regions, is thus provided.

The multi-well assembly of the present invention also improves the repeatability of positioning the filter plate and receiver plate in proper nesting relationship, so that the filter wells are not eccentric with the receiver wells. The present invention also provides a means to improve automated assembly and disassembly by means of a lead-in feature. In addition, evaporation of media from the receiver wells is reduced by providing a flat surface-to-surface contact between the filter plate and receiver plate.

DETAILED DESCRIPTION OF THE INVENTION

Figure 1:
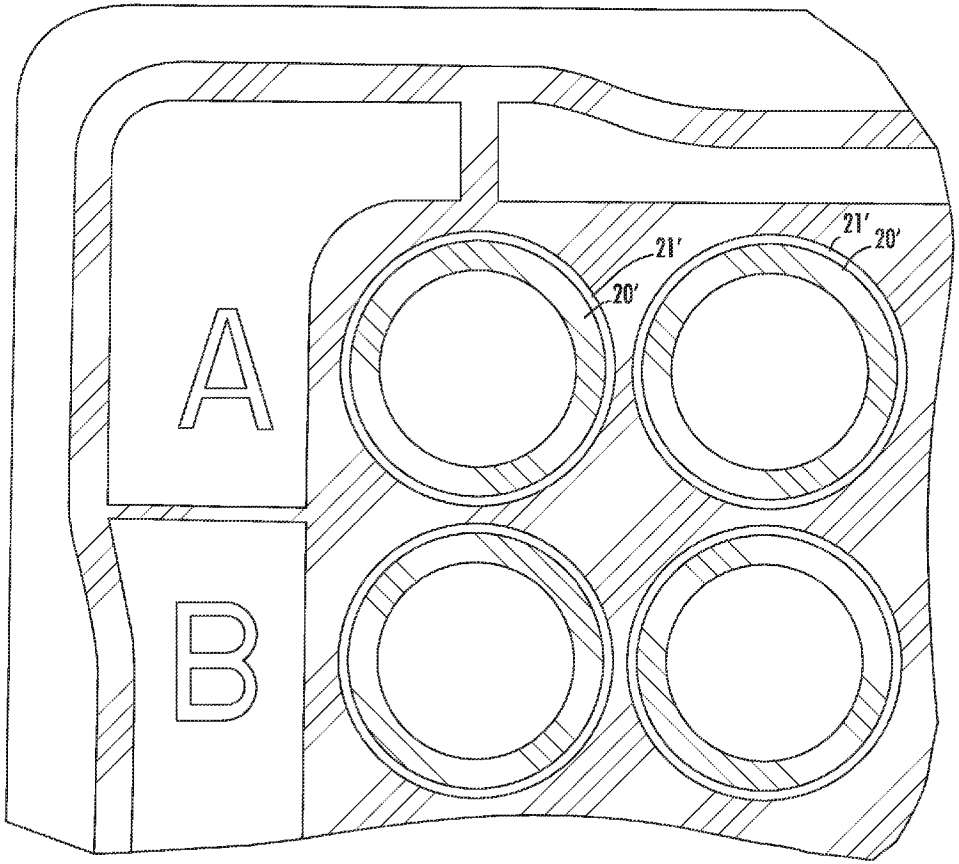
FIG. 1 PRIOR ART
FIG. 1 is a cross-sectional top view showings wells of a conventional filter plate nested in a receiver plate.
Figure 2:
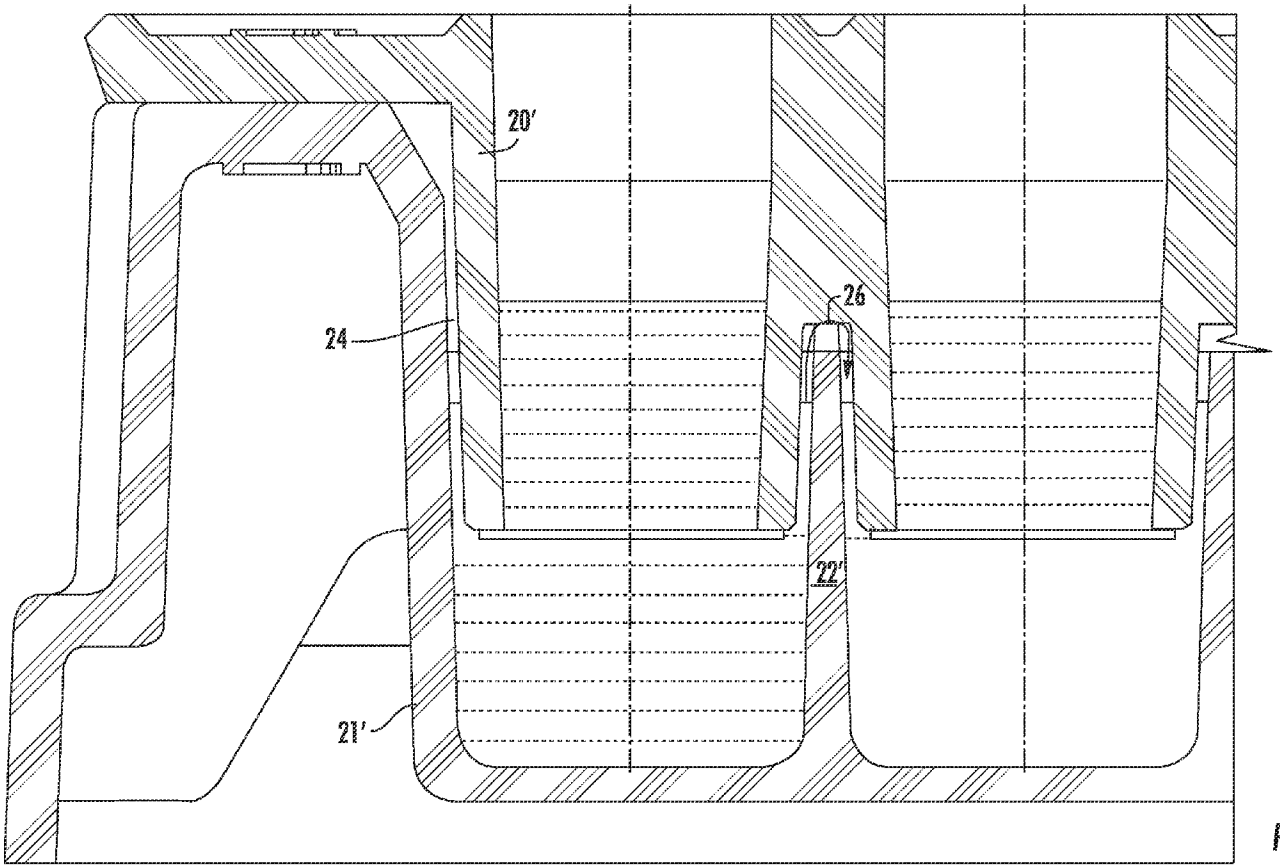
FIG. 2 PRIOR ART
FIG. 2 is a cross-sectional side view showings wells of a conventional filter plate nested in a receiver plate.

Turning first to FIGS. 1 and 2, there is shown conventional filter plate wells 20' nested in conventional receiver plate wells 21'. The filter plate wells 20' have a uniform circular cross-section, and the receiver plate wells 21' have a uniform circular cross-section as well. The outside diameter of the filter plate wells 20' is slightly smaller than the inside diameter of the receiver plate wells 21', enabling the filter plate wells 20' to be nested within the receiver plate wells as seen in FIG. 2. A small capillary gap 24 is formed between the outer walls of the filter plate wells 20' and the inner walls of the corresponding receiver plate wells 21', as well as between the inner walls of the filter plate wells 20' and the wall 22' separating receiver plate wells 21'. This gap allows for displacement and wicking of fluid and results in cross-contamination, as fluid from one receiver plate well can travel in the gap and contaminate fluid in another well, as shown by the wicking path 26 in FIG. 2.

Figure 3:
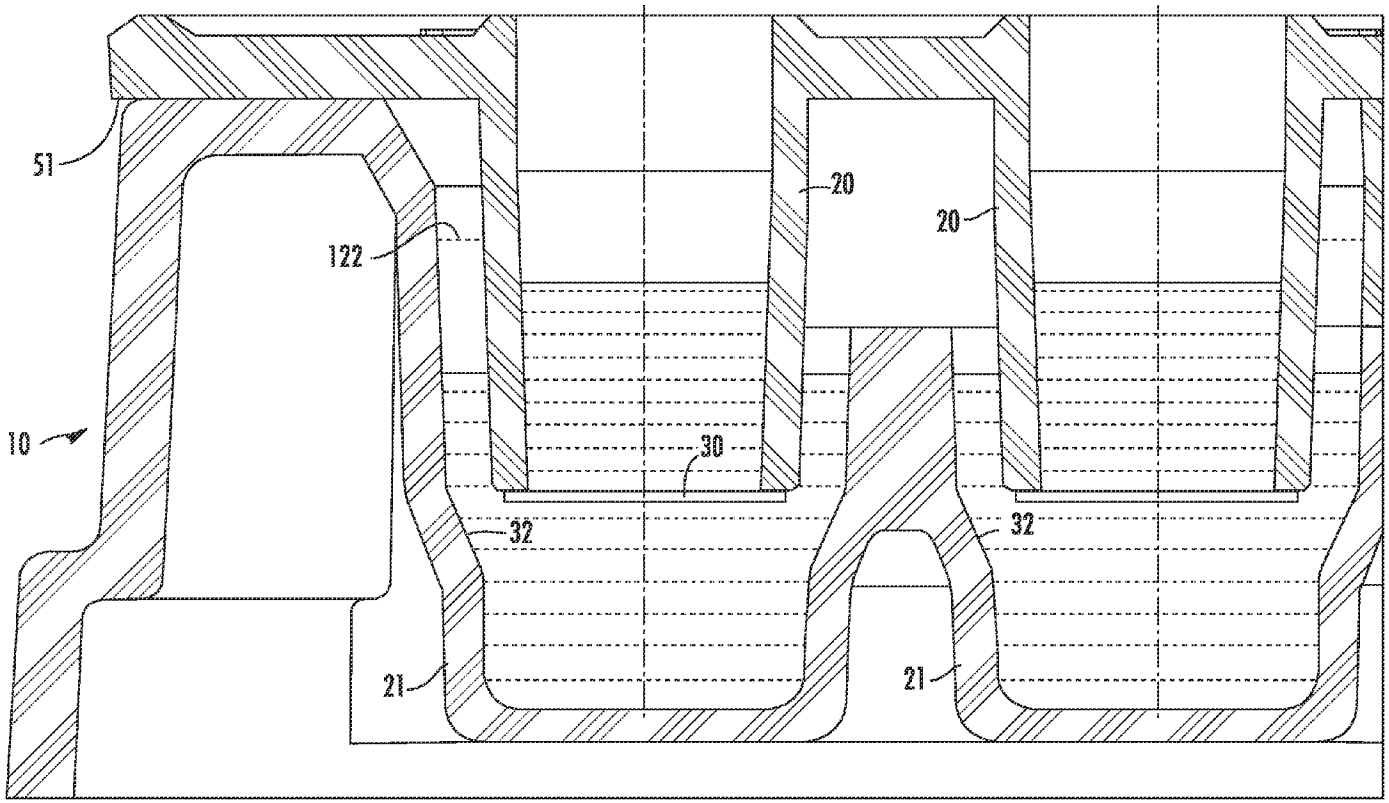
FIG. 3 is a cross-sectional side view showing a portion of a filter plate in nesting relationship with a receiver plate in accordance with the present invention.
Figure 4:
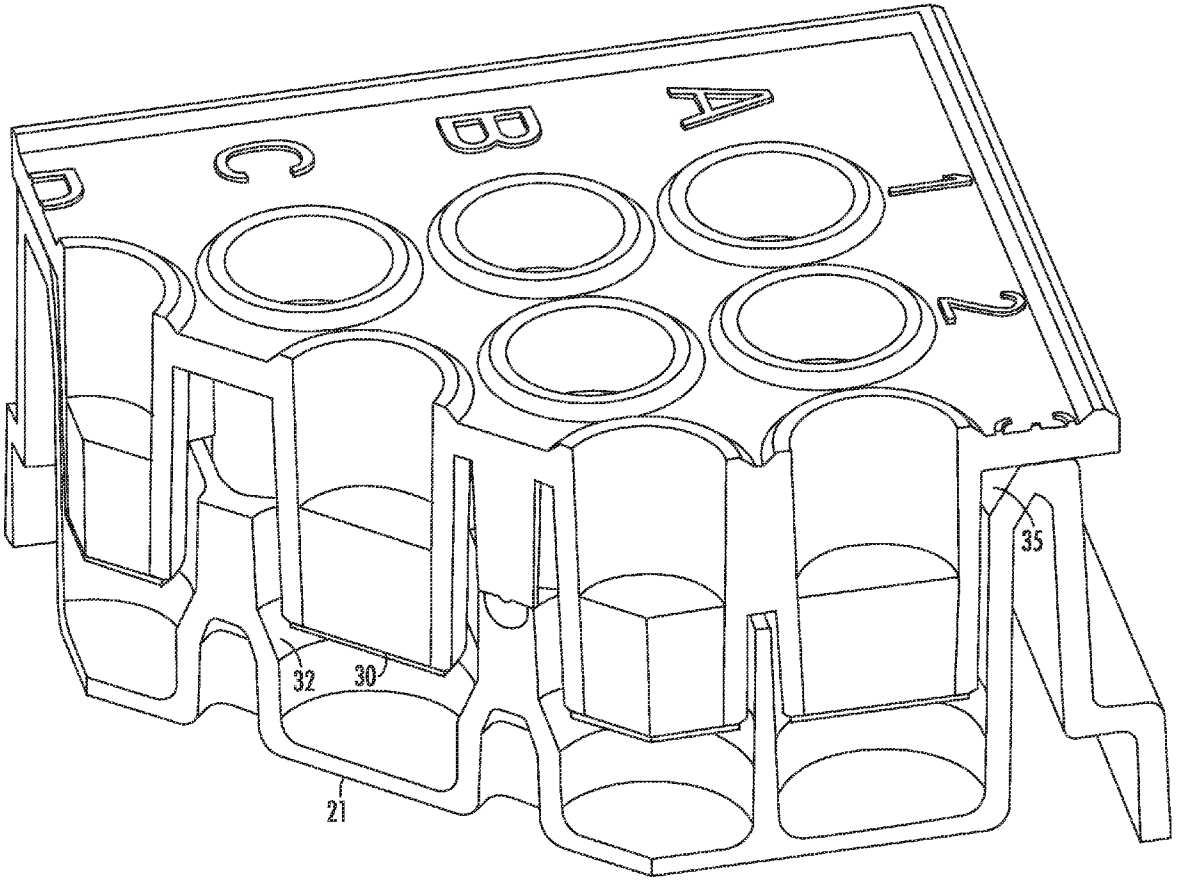
FIG. 4 is a perspective view showing a portion of a filter plate in nesting relationship with a receiver plate in accordance with the present invention.
Figure 5:
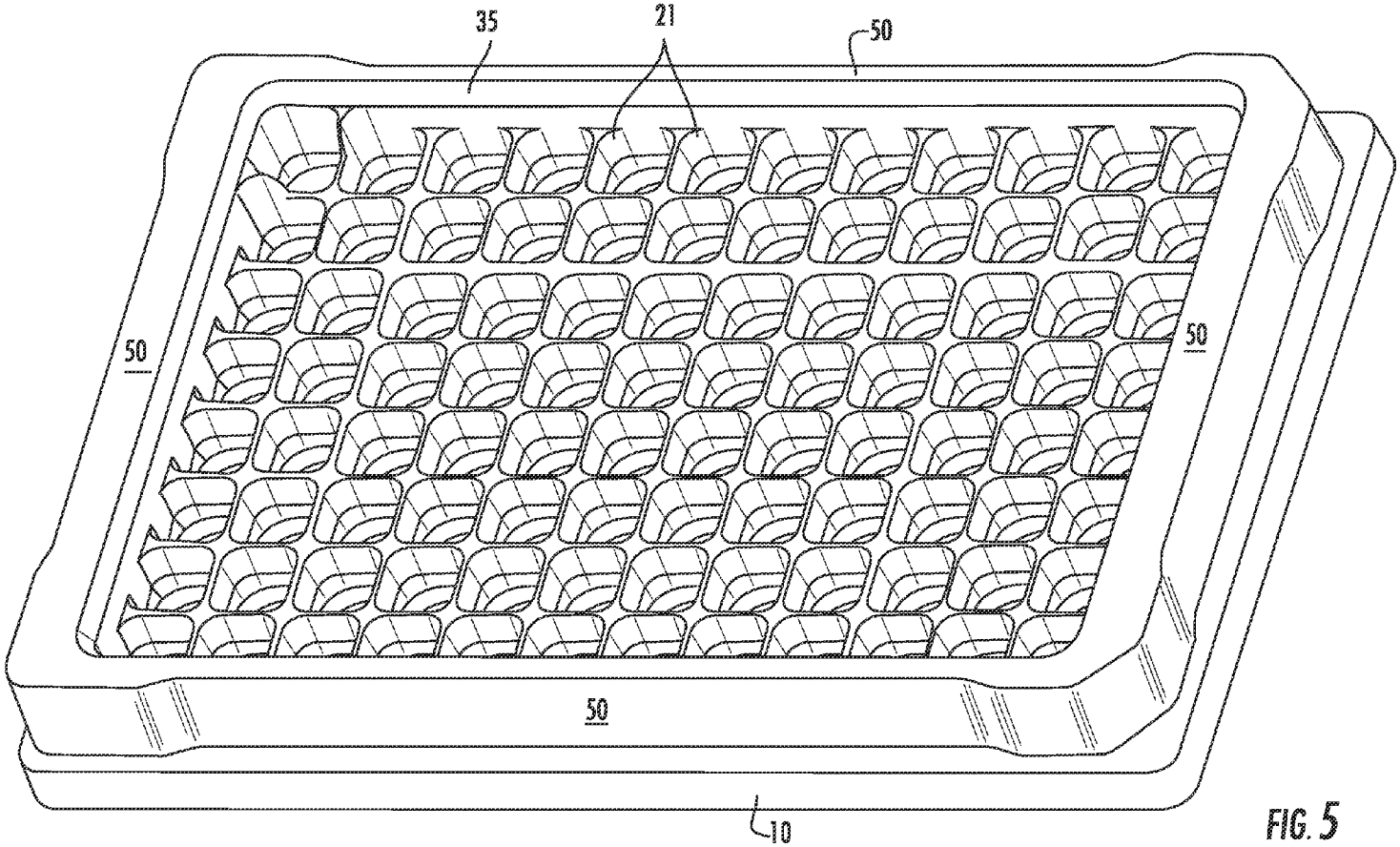
FIG. 5 is a perspective view of a receiver plate in accordance with the present invention.

FIGS. 3 and 4 illustrate a preferred embodiment of the present invention that increases the gap between the outer walls of the filter plate wells and inner walls of the receiver plate well in order to reduce or eliminate wicking and cross contamination between or among wells and to reduce the chance of displacing liquid out of the well. In the embodiment shown, the diameter in the portion of each receiver plate well 21 that receives a filter plate well 20 is increased, so that the gap 122 between the inner walls of each receiver plate well 21 and the outer walls of a corresponding filter plate well 20 is increased, thereby inhibiting capillary action and reducing or eliminating wicking of fluid in this gap. Preferably this portion of each receiver plate well has a substantially square cross-section, as seen in FIG. 5, although other shapes, including teardrop, are within the scope of the invention. This increased diameter region of the well also provides a pathway for air to escape when the filter plate is placed in nesting relationship with the receiver plate. Any air bubbles that otherwise would become trapped underneath the membrane during the assembly of the plates now can travel out the gap between the filter plate well and the receiver plate well.

Where the upper region of the receiver plate is in a square cross-section, a suitable gap between the outer wall of a nested filter plate well 20 and the inner wall of a receiver plate well 21 at the four corners of the square is a maximum of 0.039 inches, depending on the corner radius chosen, with a minimum gap of about 0.010 inches at the four side walls. The minimum gap is dictated by the ANSI/SBS array spacing standard and the outside diameter of the filter plate well 21'.

Since wicking of fluid is not an issue in the region of each receiver well below where each filter plate well nests when in the assembled condition (e.g., in the region of each receiver plate well that is below the effective area of the membrane 30 of each filter plate well), the diameter and therefore the volume of this region can be smaller than the region that receives and accommodates each filter plate well. Accordingly, in a preferred embodiment of the invention, each receiver plate well 21 transitions from a larger diameter region in the area that receives a filter plate well 20 to a smaller diameter region in the area that is below where each filter plate well 20 nests. Although the particular shape of this region is not particularly limited and can include a teardrop shape, preferably this region of each receiver plate well 21 is circular in cross-section, in order to improve liquid recovery and to control the amount of media volume for the experiment. More particularly, were the square cross-section continued from the region that receives the filter plate well to the region below where the filter plate well nests, un-recovered media would become trapped in the well corners, especially during automated liquid removal in which a pipette is extracting liquid from a single location and tipping the plate is not possible. Since it is only necessary to have media directly under the effective membrane area, the diameter of the lower region of the receiver plate well can be substantially the same as the outer dimensions of the filter well 20, and preferably the same as the effective membrane diameter so that fluid can transfer between each filter well and corresponding receiver well, through the membrane, without obstruction, to this region of the receiver well. Preferably no region of the receiver plate well is less than the effective membrane area, so that the entire membrane surface remains visible to plate readers when viewed from the bottom of the plate.

The transition from the larger diameter region to the smaller diameter region is preferably uniform in order to reduce hold up or un-recovered media. In the embodiment shown, the transition results in angled wall sections 32 when cross sections are taken through corners of the square well, as shown in FIG. 3. This angled section will vary from zero degrees (as measured from a vertical axis) for sections taken through the side walls (as shown in FIG. 2) to a maximum angle which is dictated by the corner radius and the height of the transition. The shape of the upper and lower sections and the height of translation will determine the maximum angles that are produced. For proper drainage, it is desirable to have angles less than 70 degrees when measured from vertical.

Proper and reproducible placement of the filter plate wells within the receiver plate wells is important to avoid cross contamination, as eccentric nesting of the filter plate wells in the receiver plate wells can cause the gap between the wells to vary and allow wicking. Also, the well location needs to be properly maintained through the experiment during manual and automated handling, mixing, and shaking to prevent liquid sloshing, spilling, and wicking. Proper placement, particularly during automation, can be enhanced in accordance with one embodiment of the present invention by providing a chamfer 35 along the outside perimeter of the array of wells in the receiver plate 10. The chamfer functions to guide the outside edges of filter plate wells 20 into proper nesting relationship with the receiver plate wells 21. By locating the chamfer around the perimeter of the well array, various configurations of filter plates can be guided into place, even where the filter late has a skirt that would interfere with such a guide were it positioned about the outside edge of the receiver plate rather than about the periphery of the well array. Preferably the chamfer is formed at a 45° angle, sloping toward the wells as seen in FIG. 5.

Figure 6:
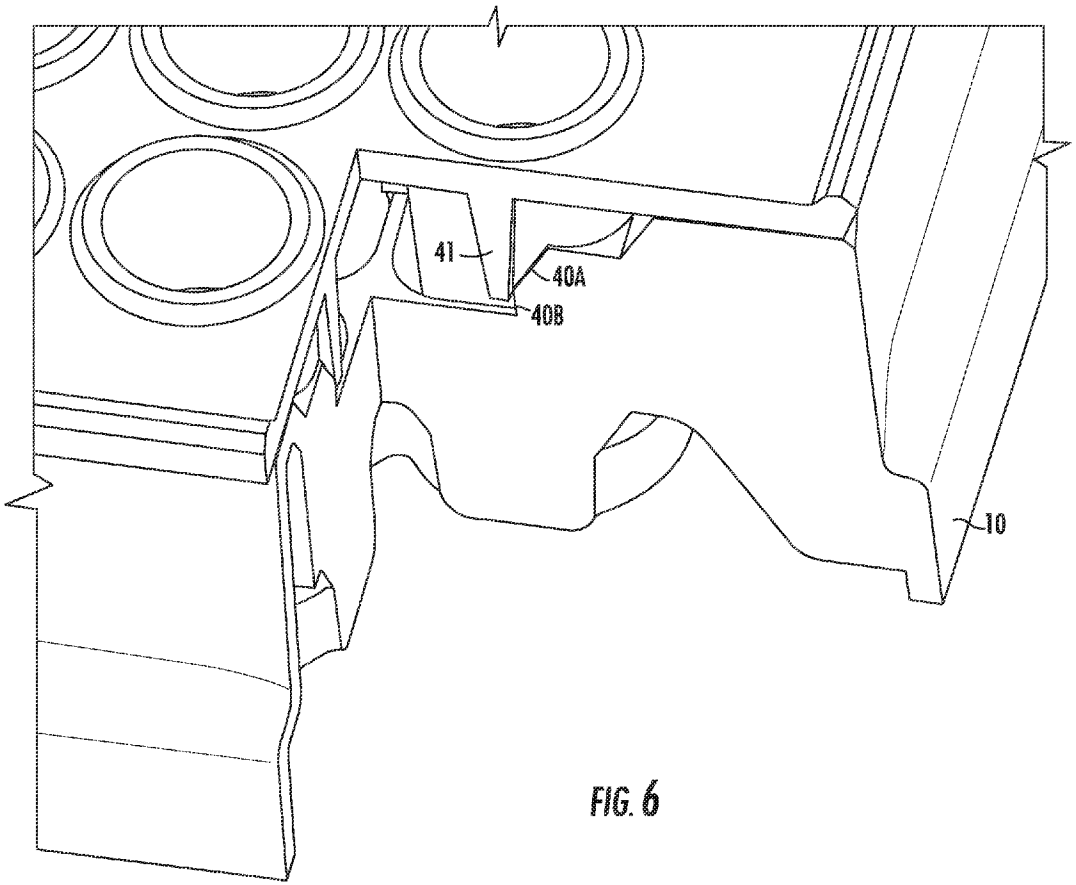
FIG. 6 is a perspective view of a portion of a filter plate in nesting relationship with a receiver plate showing filter plate support ribs and a positioning rib in accordance with the present invention.
Figure 7:
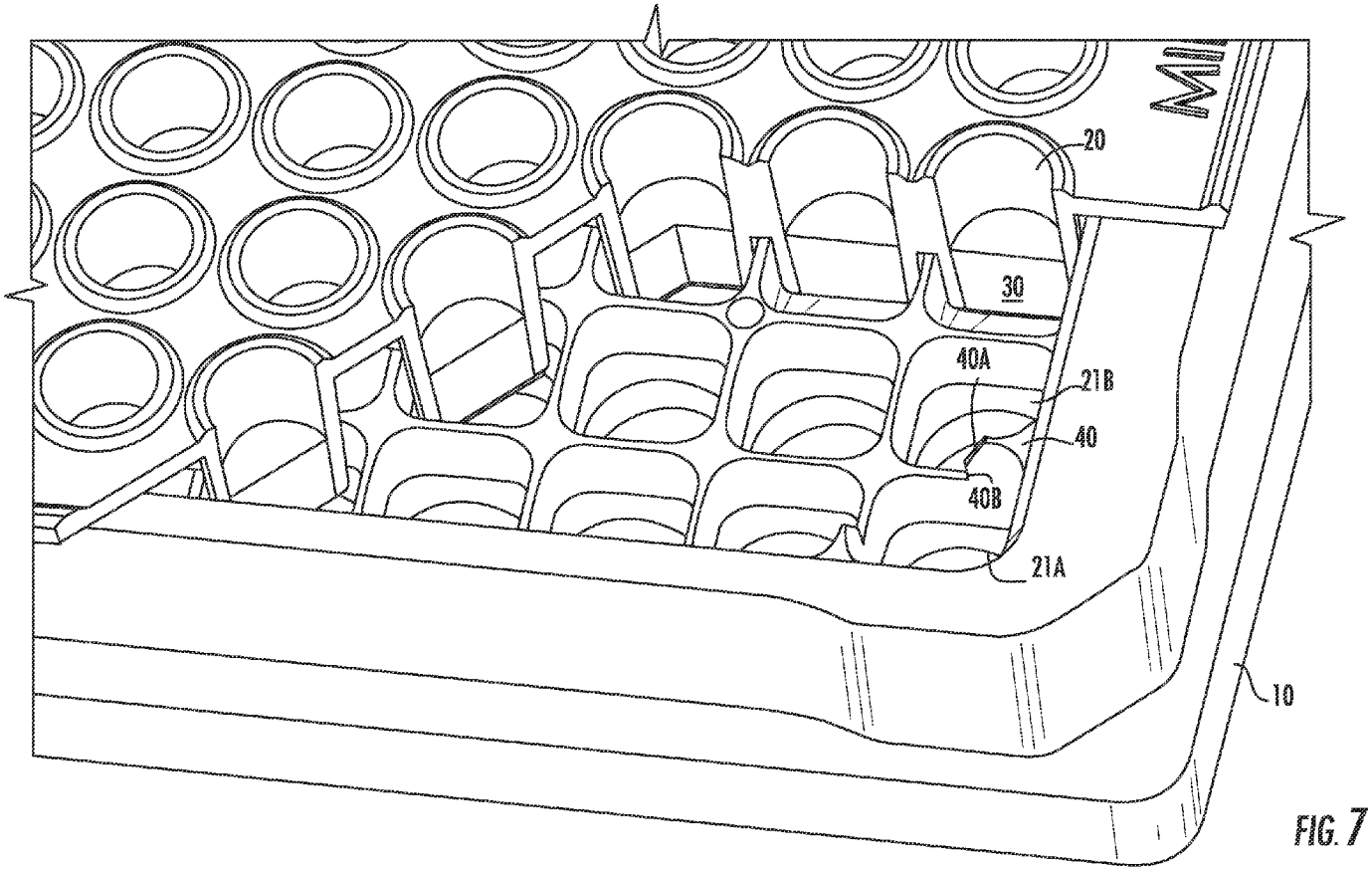
FIG. 7 is a perspective view of a portion of a filter plate nested in a receiver plate and showing a position rib in accordance with the present invention.

To further guide the assembly of the filter plate and receiver plate, positioning ribs or posts 40 can be provided in one or more, preferably at least two, wells of the receiver plate that mate with corresponding well support ribs or posts 41 in corresponding filter plate wells. The positioning ribs also provide a means of keeping the filter plate from moving or shifting during handling, mixing, and shaking. As best seen in FIG. 7, a positioning rib 40 is provided between a corner well 21A and an adjacent well 21B in the receiver plate 10. Preferably the rib 40 has a flat top that extends towards the well array and is slightly lower than the top face of the receiver plate. The rib 40 terminates in a sidewall that includes a chamfered region 40A, preferably angled at about 45°, and a straight or perpendicular portion 40B perpendicular to the top of the well wall. The chamfered lead-in and tapered mating face of the rib 40 guide a corresponding support rib 41 (FIG. 6) on a corresponding well of the filter plate. Preferably the support ribs 41 are tapered, narrowing towards their free ends. Positioning ribs 40 are only necessary at two points in the plate to control translation in two directions and rotation about the vertical axis. Although the positioning ribs 40 are preferably located at opposite corner wells, it is within the scope of the present invention to provide them at any point within the plate, including the outside well walls or the gap between well walls (in which case the rib would fit in between the filter plate wells with a chamfer lead in and tapered wall on each side). The rib or pin features could also use the outside wall of the filter plate 20' to provide the means of location.

In order to reduce evaporation of media from the receiver wells, particularly from the peripheral receiver wells, the filter and receiver plates preferably are configured so that there is a flat surface-to-surface contact area between the plates to seal the wells. Thus, the area 50 that is peripheral to the chamfered lead-in 35 of the receiver plate is flat or planar (FIG. 5), as is the corresponding area 51 of the filter plate that sits on area 50 (FIG. 3), the effectively creating a face seal when the filter plate is in nesting relationship with the receiver plate. This allows the filter wells to hang in the receiver wells, and eliminates communication with the outside environment. There are other means for ensuring a region of intimate contact between the filter plate and receiver plate with no air gap and minimum contact with the environment. One such method is a raised bead around the periphery of the receiver plate. This raised bead could be an overmolded elastomeric material, thus acting as a gasket type seal.

What is claimed is:

1. A multi-well device comprising:

a filter member having a plurality of filter wells each having a filter well membrane, and a receiver member having plurality of receiver wells each having a bottom, said receiver member adapted to receive said filter member in nesting relationship whereby each of said filter wells extends into a respective receiver well, in one-to-one relationship, to a position spaced from said receiver well bottom, thereby defining in each said receiver well a filter well occupied region and a region unoccupied by a filter well, said filter well occupied region having a diameter larger than any diameter of said region unoccupied by a filter well, each said unoccupied region of each said receiver well comprising a transition region and a remainder region, said transition region being located at a point at or below the location of each said filter well membrane when each said filter well is in nesting relationship with a corresponding receiver well, and located above said receiver well bottom, wherein each receiving well wall in each said transition region is angled radially inwardly, and transitions to a portion of said receiving well wall that does not angle radially inwardly.

2. The multi-well device of claim 1, wherein said filter well occupied region has a substantially square cross-section.

3. The multi-well device of claim 1, wherein said filter well unoccupied region has a substantially circular cross-section.

4. The multi-well device of claim 1, wherein each said filter well has a filter well wall, and wherein said diameter of said filter well occupied region is sufficient to create a gap between said filter well wall of a nested filter well and said receiver well wall of a corresponding receiver well, said gap being large enough to impede capillary action in said gap.

5. The multi-well device of claim 1, wherein said filter well has a diameter, and wherein said filter well unoccupied region has a diameter substantially the same as said filter well diameter.

* * * * *